US005401089A

United States Patent [19]

Inagaki et al.

[11] Patent Number: 5,401,089

[45] Date of Patent: Mar. 28, 1995

[54] DISPLAY UNIT LIFTER

[75] Inventors: Masahiko Inagaki; Osamu Satsukawa; Yoshihiro Umeda; Shin-ichi Kamo, all of Shizuoka, Japan

[73] Assignee: Yamaha Corporation, Shizuoka, Japan

[21] Appl. No.: 209,450

[22] Filed: Mar. 10, 1994

[30] Foreign Application Priority Data

Mar. 12, 1993 [JP] Japan ..... 5-052710

[51] Int. Cl.[6] ..... A47B 85/06

[52] U.S. Cl. ..... 312/7.2; 312/306; 312/312

[58] Field of Search ..... 312/7.2, 21, 29, 306, 312/312, 319.8

[56] References Cited

U.S. PATENT DOCUMENTS

| | | | |
|---|---|---|---|
| 2,687,934 | 8/1954 | Gipple | 312/306 |
| 2,854,308 | 9/1958 | Harris, Jr. | 312/312 |
| 2,875,012 | 2/1959 | Riley | 312/306 |
| 3,761,152 | 9/1973 | Cory | 312/312 |
| 4,065,194 | 12/1977 | Mattia | 312/306 |
| 4,568,132 | 2/1986 | Watt | 312/312 |
| 5,096,275 | 3/1992 | Pappas | 312/312 |
| 5,273,352 | 12/1993 | Saper | 312/312 |

*Primary Examiner*—Kenneth J. Dorner
*Assistant Examiner*—Rodney B. White
*Attorney, Agent, or Firm*—Ostrolenk, Faber, Gerb & Soffen

[57] ABSTRACT

A lifter particularly usable for an LC display unit includes a slide board bearing the display unit overhead and driven for vertical movement by a lift drive motor associated with a swing arm kept in rolling contact with the slide board, a gear assembly mounted to the slide board for converting rotation of a tilt drive motor into corresponding tilting of the display unit, and various sensors for controlling rotation of the motors on detection of the positions of the display unit. Vertical movement of the display unit requires a quarter rotation of the swing arm which is very small in ambit and, as a consequence, a compact and light design of the entire lifter construction. The rolling contact of the swing arm with the slide board assures reliable fail-safe function when smooth vertical movement of the slide board is hindered by accidental introduction of a foreign matter in its path of travel.

6 Claims, 8 Drawing Sheets

DISPLAY UNIT LIFTER

BACKGROUND OF THE INVENTION

The present invention relates to a display unit lifter, and more particularly relates to improvements in construction and function of a lifter suited, in particular, for use with a liquid crystal (LC) display unit.

Various lifters have been proposed for automatic lifting of display units. Operations of these automatic lifters are commonly based on use of a pinion-rack combination. More specifically, a table bearing a display unit is associated with at least one pinion driven for rotation by a drive motor carried by the table. The pinion is kept in meshing engagement with a vertical rack. As the pinion rotates on the rack, the table with the display unit moves upwards and downward depending on the direction of pinion rotation.

In the construction of one typical example of the conventional lifter, a horizontal table bearing a display unit and its accessories is encased within a housing for vertical movement. A drive motor attached underneath the table has a pair of opposite output shafts. The output shafts extend horizontally across the interior of the housing and are provided with pinions fixed at their distal ends. At positions corresponding the pinions, a pair of racks are fixed vertically to one inner side wall of the housing in meshing engagement with the associated pinions. One or more telescopic damper supports are interposed between the lower face of the table and the interior bottom of the housing. As the pinions are driven for rotation, the table with the display unit moves vertically in the housing while the damper supports cushion such vertical movement of the table with the display unit.

The conventional lifter of the above-described construction is well suited for use with a cathode ray tube (CRT) display unit which is rather large and heavy in construction. The table is required to have a dimension and strength sufficient for bearing such a large and heavy CRT display unit. Use of the pinion-rack combinations necessitates an increased dimension of the housing, namely the entire system. As well known in the field of art, LC display units are generally lighter and smaller in construction than CRT display units. As a consequence, the conventional lifter of the above-described construction is rather unsuited for use with a contemporary LC display unit.

When any foreign materials accidentally fall on the pinion or on the rack, the pinion cannot rotate smoothly on the associated rack. Subsequent forced rotation of the pinion unavoidably causes breakage and/or malfunction of the related parts such as the drive motor.

In addition, due to poor luminous emanation on the screen of an LC display unit, images appearing on the screen of an LC display unit are not so clear as those on a CRT display. In order to compensate this disadvantage, it is necessary to correctly position the screen of an LC display unit in relation to the user's eyes. Stated otherwise, the screen angle of a LC display unit should be adjusted to tile optimum one in relation to the user's eyes. Since it is rather cumbersome to manually optimize the screen angle at every use of an LC display unit, it is strongly wanted by general user to provide a new system which enables automatic optimization of the screen angle. Despite such a demand, the above-described construction of the conventional lifter has no function of the automatic angular optimization.

SUMMARY OF THE INVENTION

It is thus the principal object of the present invention to provide a lifter for an LC display unit which is significantly compact in construction and light in weight.

It is another object of the present invention to provide a lifter for an LC display which has a reliable fail-safe function.

It is the other object of the present invention to provide a lifter for an LC display which enables automatic optimization of screen angle without any manual assistance.

In accordance with the basic aspect of the present invention, a display unit lifter comprises a housing having an upper opening for passage of the display unit, a display lifting unit arranged within the housing in mechanical connection to the display unit, a display tilting unit mounted to the display lifting unit in mechanical connection to the display unit, and a lift detector unit arranged within the housing in electric connection to the display tilting unit. The display lifting unit includes a lift drive motor fixedly mounted to the housing, and a slide board mechanically coupled to the lift drive motor for vertical movement in the housing and carrying the display unit overhead via at least one hinge. The display tilting unit includes a tilt drive motor mounted to the slide board of the display lifting unit, and means for converting output rotation of the tilt drive motor into corresponding tilting of the display unit about the hinge on the slide board. The lift detector unit faces a path of the vertical movement of the slide board within the housing.

DESCRIPTION OF THE PREFERRED EMBODIMENTS

Figure 1:
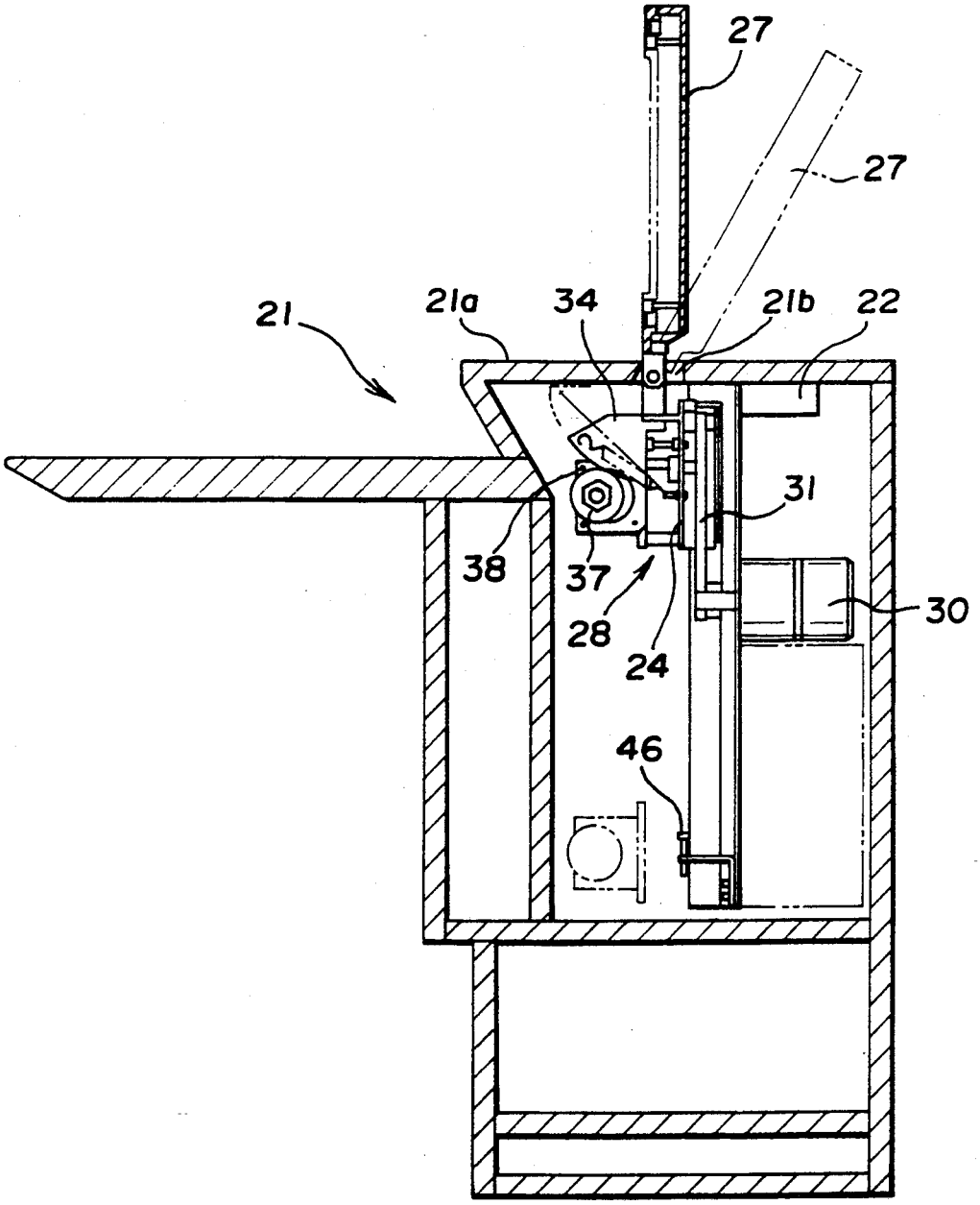
FIG. 1 is a side view, partly in section, of one embodiment of the display unit lifter in accordance with the present invention.
Figure 2:
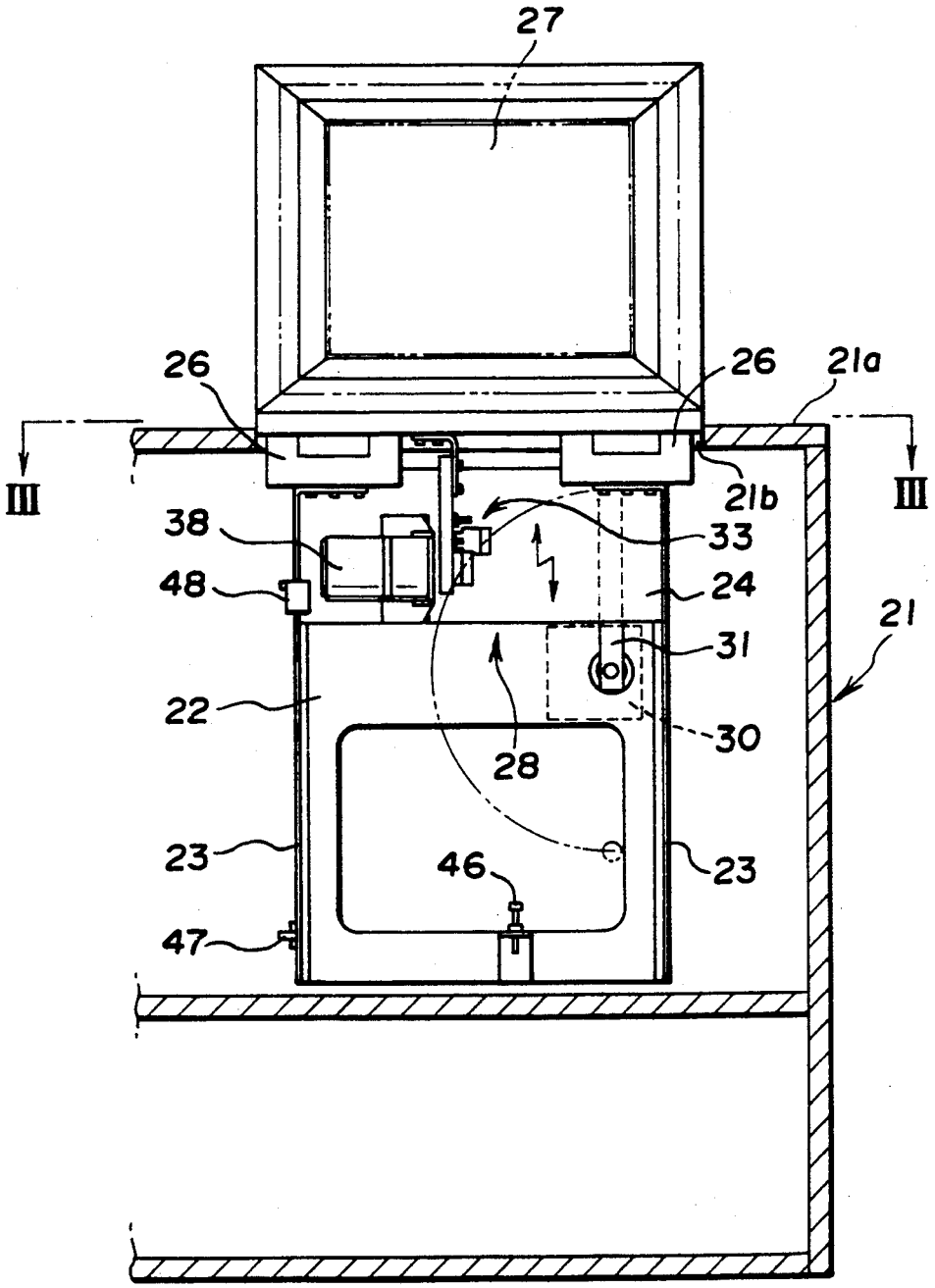
FIG. 2 is a front view, partly in section, of the lifter shown in FIG. 1.
Figure 3:
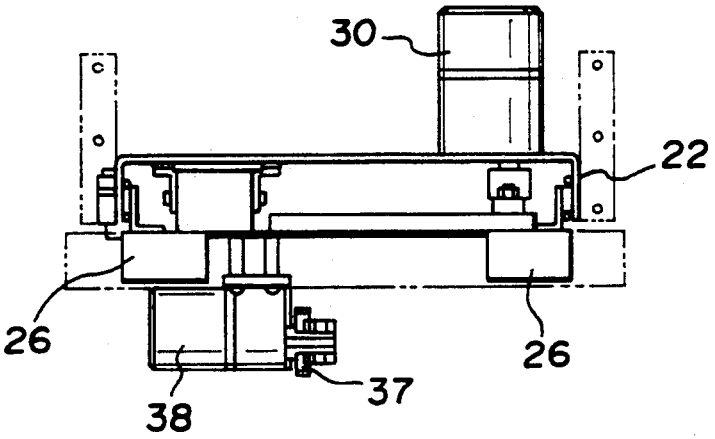
FIG. 3 is a top view of the lifter seen in the direction of III—III in FIG. 2.
Figure 4:
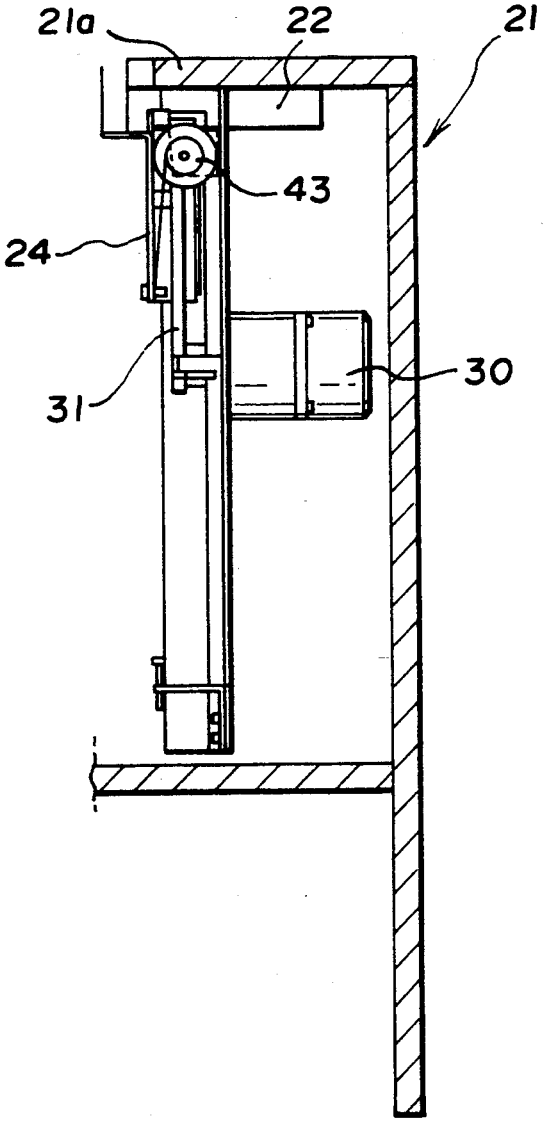
FIG. 4 is a side view, partly in section, of the display lifting unit of the display unit lifter shown in FIGS. 1 and 2.

As shown in FIGS. 1 and 2, an LC display unit 27 is usually stored at a stand-by position within a hollow housing 21 such as an operating task and brought to an operating position atop the housing 21 when used. For mounting of various elements in position within the housing 21, a main frame 22 is fixedly arranged vertically across the interior of the housing 21. A top opening 21b is formed through the top wall 21a of the housing 21 for free passage of the LC display unit 27 during its travel between the stand-by and operating positions. At positions corresponding to lateral ends of the LC display unit 27, a pair of slide guide posts 23 are fixed to the top wall 21a of the housing 21 while vertically extending downwards.

As stated above, the display unit lifter of the present invention includes, as major components, a display lifting unit, a display tilting unit and a lift detector unit.

Figure 6:
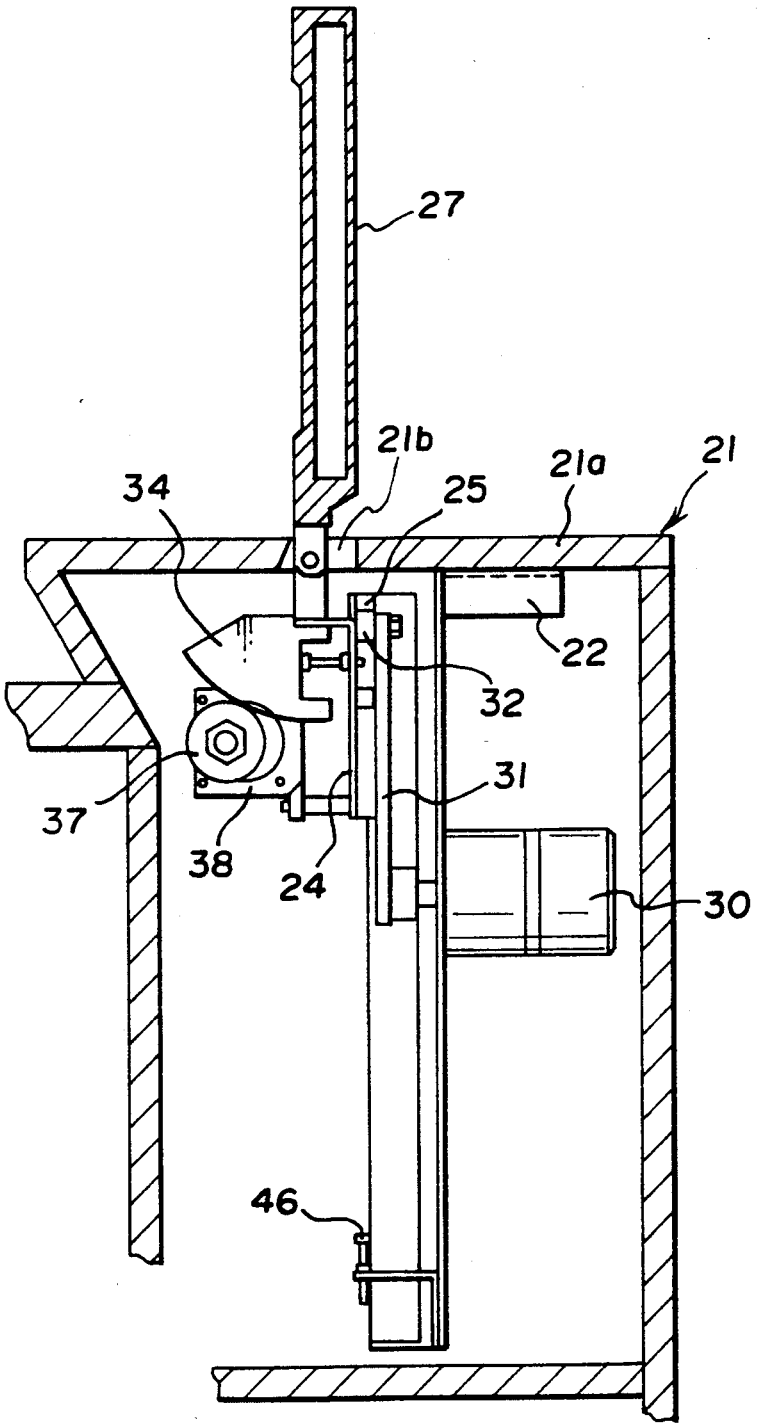
FIG. 6 is an enlarged side view partly in section, of the display lifting and tilting units.

The display lifting unit is shown in FIGS. 1 to 4 and 6. The display lifting unit includes a slide board 24 arranged in a slidable engagement with the slide guide posts 23 fixed to the top wall 21a of the housing 21. As best seen in FIG. 6, the slide board 24 is accompanied atop with a horizontal guide rail 25. A pair of hinges 26 are fixed to the top end of the slide board 24 in order to hold the LC display unit 27 in a tiltable fashion.

Figure 5:
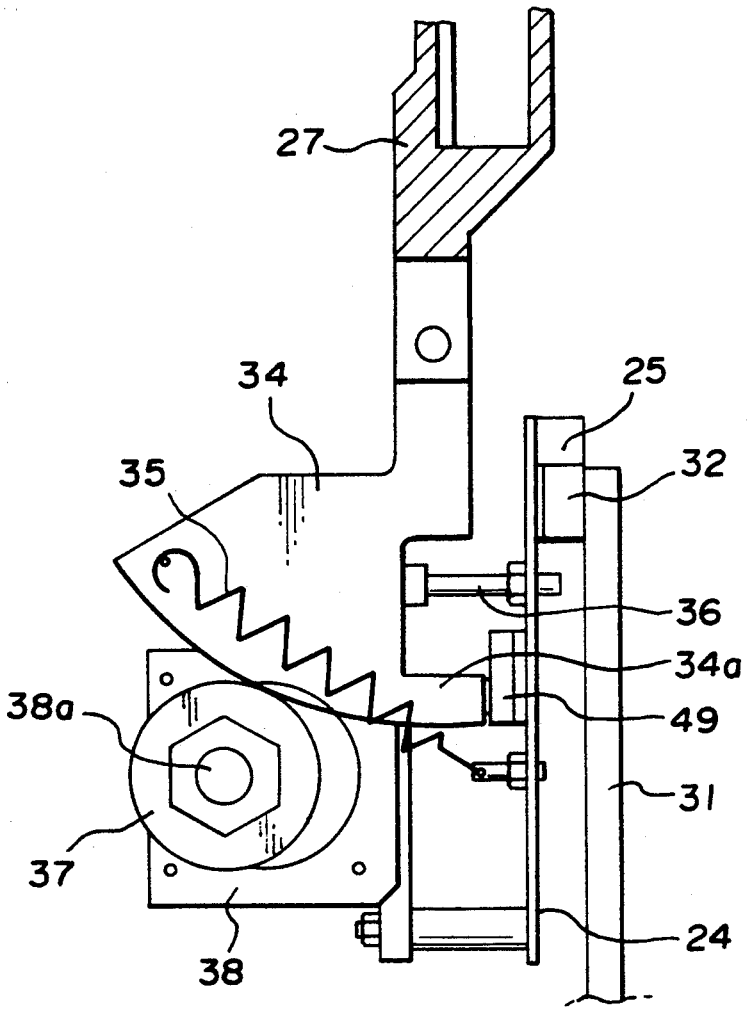
FIG. 5 is a side view of the display tilting unit of the display unit lifter shown in FIGS. 1 and 2.

A lift drive motor 30 is fixed to the rear face of the main frame 22 and its output shaft extends forwards through the main frame 22. A radial swing arm 31 is fixed at its proximal end to the output shaft of the lift drive motor 30. As best seen in FIGS. 5 and 6, the swing arm 31 rotatably carries at its distal end a roller 32 which is kept in rolling contact with bottom face of the guide rail 25 attached atop the slide board 24. Through this rolling contact with the guide rail 25, the roller 32 on the swing arm 31 supports the slide board 24 and the LC display unit 27. As the roller 32 changes its vertical position due to the swing of the swing arm 31 driven by the lift drive motor 30, the slide board 24 moves vertically along the slide guide posts 23 and, as a consequence, the LC display unit 27 travels between the stand-by and operating positions. Thus, the slide board 24, the lift drive motor 30 and the swing arm 31 form the major part of the display lifting unit.

The display tilting unit is shown in FIGS. 5 to 7 and 9. The display tilting unit includes a sector gear 34 fixed to the lower end of the LC display and extending downwards. The sector gear 34 is located in a vertical plane which extends substantially normal to the plane of the slide board 24. The sector gear 34 has its teeth along its arc lower end and pulled towards the slide board 24 by a tension spring 35. A stopper 36 is secured to the slide board 24 whilst projecting forwards in order to abut against the rear end of the sector gear 34. That is, when the rear end of the sector gear 34 abuts against the stopper 36, the LC display unit 27 above the sector gear 34 is registered at an upright position shown with solid lines in FIGS. 1 and 6.

A tilt drive motor 38 is supported in front of and by the slide board 24 with its output shaft 38a extending horizontally in parallel to the plane of the slide board 24. A transmission gear 37 is secured to the output shaft 38a in meshing engagement with the sector gear 34. The tilt drive motor 38 is controlled in rotation by an electric signal from the lift detector unit as later described in more detail.

Figure 9:
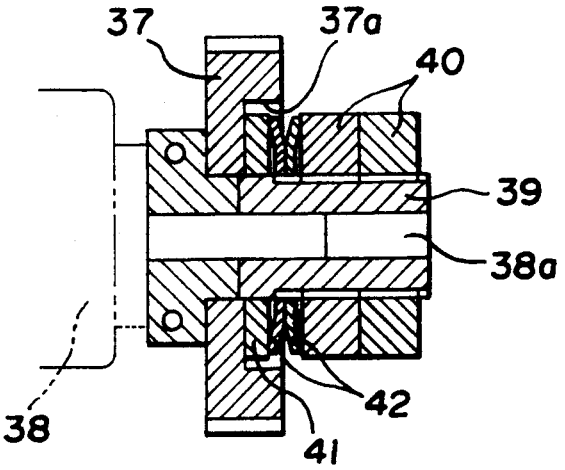
FIG. 9 is a sectional view of the main part of the display tilting unit.

A detailed construction relating to tile transmission gear 37 is shown in FIG. 9, in which a sleeve 39 is inserted over the output shaft 38a of the tilt drive motor 38 and the slip lock gear 37 is rotatably inserted over the sleeve 39. A stopper nut 40 is screwed over the sleeve 39 whilst being somewhat spaced from the transmission gear 37. A cylindrical recess is formed in the side face of the transmission gear 37 whilst opening towards the stopper nut 40 and a ring 41 is received in the cylindrical recess 37a. A pair of washer springs 42 are inserted between the ring 41 and the stopper nut 40 whilst surrounding the sleeve 39.

Rotation of the tilt drive motor 38 is usually transmitted to the transmission gear 37 via the sleeve 39, the washer springs 42 and the ring 41 utilizing an elastic contact mechanism. When the LC display 27 is manually forced to tilt without rotation of the tilt drive motor 38, mechanical slip starts in the above-described elastic contact mechanism and, as a consequence, the tilt drive motor 38 is allowed to remain standstill despite rotation of the transmission gear 37 caused by tilting of the LC display unit 27.

The lift and tilt drive motors 30 and 38 are both reversible in rotation.

Figure 7:
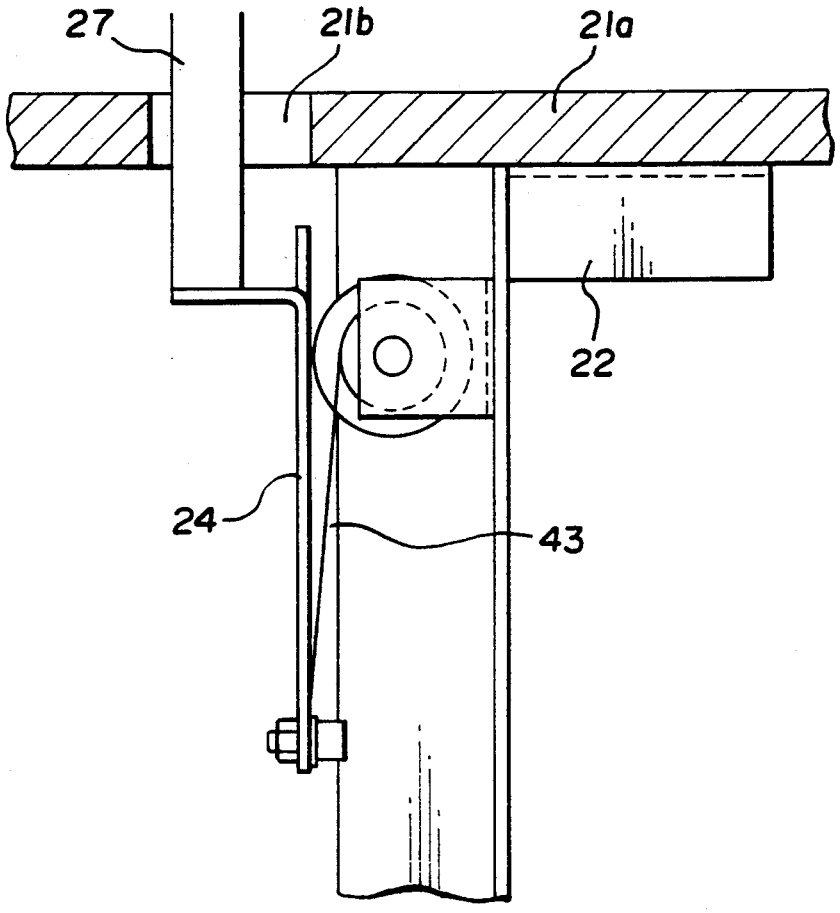
FIG. 7 is an enlarged side view, partly in section, of the main part of the display tilting unit.
Figure 8:
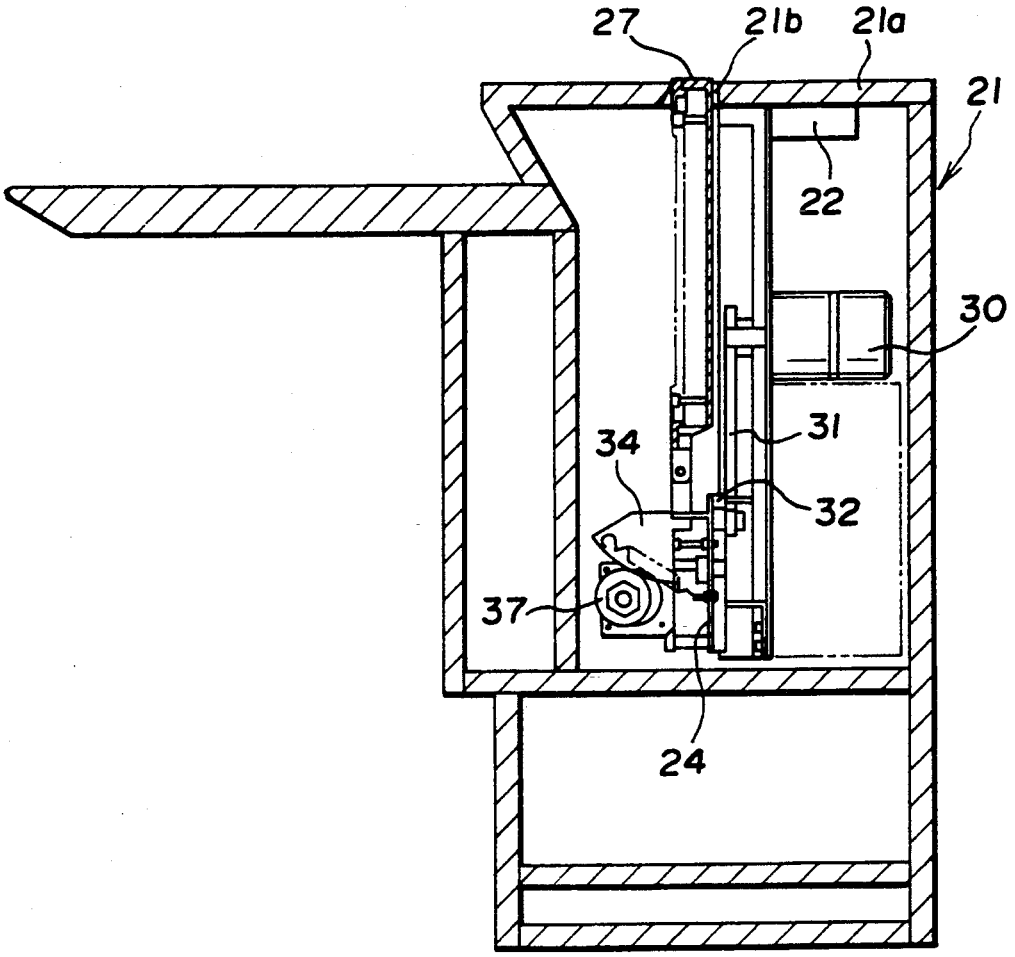
FIG. 8 is a side view, partly in section, of the display unit lifter shown in FIGS. 1 and 2 with a display unit being located at its stand-by position within a housing.

As shown in FIG. 7, a coil spring 43 is attached at one end to the main frame 22 and at the other end to tile rear face of the slide board 24. The spring force urges the slide board 24 upwards in order to mitigate a load on the lift drive motor 30 at lifting the LC display 27.

Thus, the tilt drive motor 38, the transmission gear 37 and the sector gear 37 form the major part of the display tilting unit.

The lift detector unit is best seen in FIG. 2, in which a stopper 46 is fixed to the lower end of the main frame 22 in order to limit the lowest descending position of the slide board 24. A lower sensor 47 is fixed to one slide guide post 23 at a level near the stopper 46 in order to detect arrival of the slide board 24 at the lowest descending position. This lower sensor 47 is electrically connected to the lift drive motor 30 of the display lifting unit. An upper sensor 48 is fixed to the same slide guide post 23 at a level somewhat above the lift drive motor 30 in order to detect arrival of the slide board 24 at the highest ascending position. This upper sensor 48 is also electrically connected to the lift drive motor 30 as well as to the tilt drive motor 38.

As best seen in FIG. 5 the lift detector unit further includes a tilt sensor 49 fixed to the slide board 24 facing the sector gear 34 which is provided with a rear projection 34a. When the LC display unit 27 is registered at the upright position, the rear projection 34a comes into contact with the tilt sensor 49 which there upon passes a corresponding detection signal to the tilt drive motor 38 in order to control its rotation.

Figure 10:
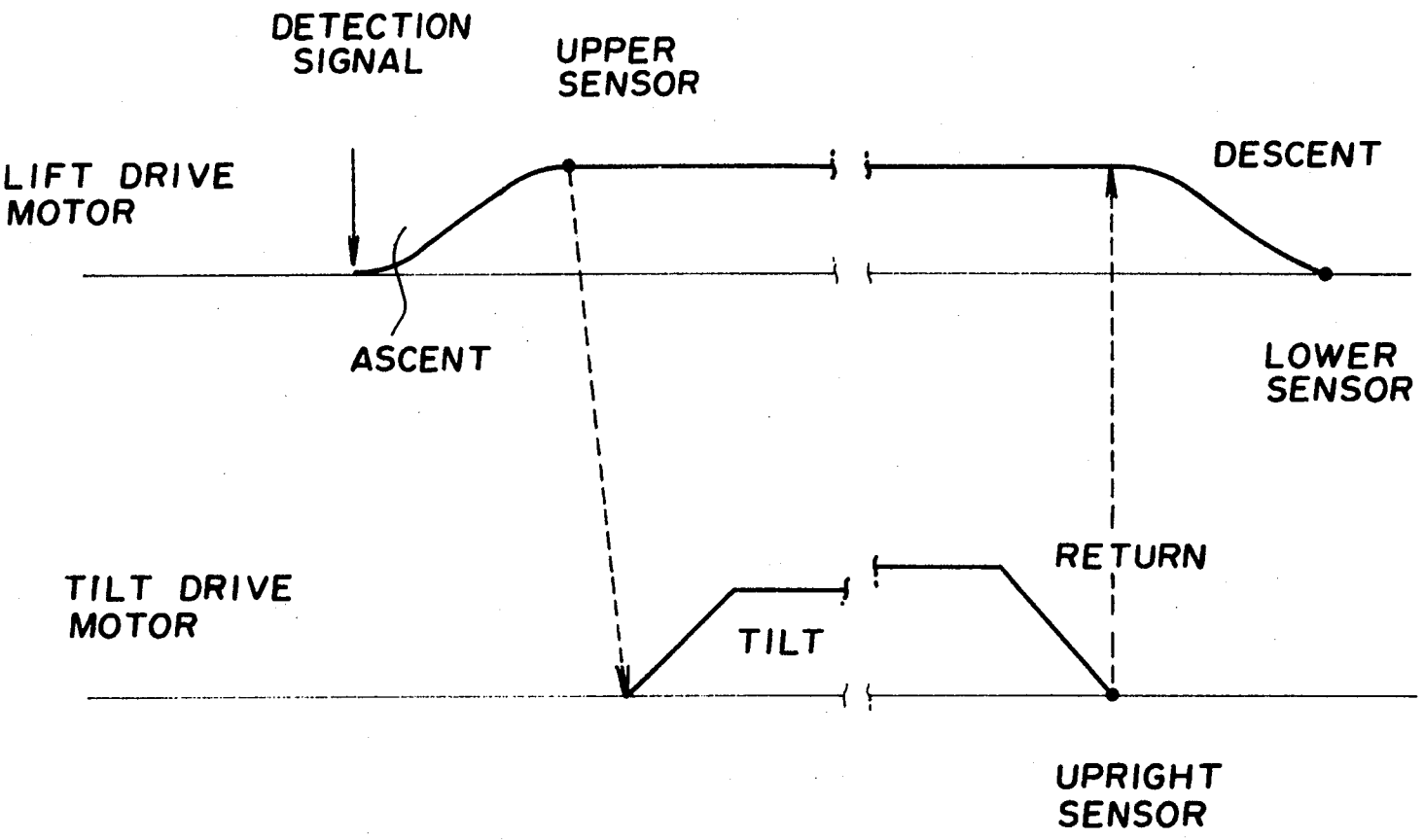
FIG. 10 is an operating diagram of the display unit lifter in accordance with the present invention.

The display unit lifter of the above-described construction operates as follows, reference being made to the operation diagram shown in FIG. 10. When not in use, the LC display unit 27 is kept at the stand-by position within the housing 21. As a lift switch not shown is manually turned on, the lift drive motor 30 starts to rotate in one direction and the swing arm 31 rotates clockwise in FIG. 2. Following this rotation, the roller 32 at the distal end of the swing arm 31 pushes up the guide rail 25 and the slide board 24 attached to the guide rail 25 ascends along the slide guide posts 23 together with the overhead LC display unit 27. During this movement of the slide board 24, the coil spring 45 (see FIG. 7) urges the slide board 24 to move upwards to mitigate the load on the lift drive motor 30.

At this vertical movement of the slide board 24, the rotary movement of the swing arm 31 is converted into the linear vertical movement of the slide board 24 thanks to the rolling contact of the roller 32 with the guide rail 25. As a result of this conversion in movement, the slide board first ascend rather slowly, increases it speed of movement thereafter, and finally returns to a slow ascent near the highest ascending position.

As the slide board 24 with the LC display unit 27 arrives at the highest ascending position, the arrival is detected by the upper sensor 48 (see FIG. 2) which thereupon passes a detection signal to the lift drive motor 30 in order to stop the rotation of the latter. At this movement, the swing arm 31 ceases it clockwise rotation at the upper dead point, i.e. a position whereat the swing arm 31 assumes an upright position, and the LC display unit 27 is kept at its highest ascending position even when the power supply to the lift drive motor 30 is turned off. The detection signal from the upper sensor 48 is also passed to the tilt drive motor 38 which thereupon starts to rotate. On rotation of the tilt drive motor 38, the transmission gear 37 forces the sector gear 34 to rotate clockwise in FIG. 5 over a prescribed angle of rotation. Then, the LC display unit 27 assumes a tilted position as shown with chain lines in FIG. 1 over the top opening 21*b* in the top wall 21*a* of the housing 21.

When it is wanted to change the degree of inclination of the LC display unit 27 after the above-described automatic setting, the elastic contact mechanism shown in FIG. 9 operates effectively. That is, when the LC display unit 27 is manually swung about the hinges 26 without rotation of the tilt drive motor 38, the transmission gear 37 tends to rotate about the sleeve 39 on the motor output shaft 38*a* while the stopper nut 40 does not follow this rotation of the transmission gear 37. As a consequence, slip starts between tile ring 41 and the washer spring 42 or between the ring 41 and the transmission gear 37 to allow manual swing of the LC display unit 27. Thus, the degree of inclination of the LC display unit 27 can be manually adjusted quite freely in addition to the initial automatic setting.

When it is wanted to return the LC display unit 27 to its upright position, the corresponding manual operation is well assisted by operation of the tension spring 35 attached to the sector gear 34 (see FIG. 5).

When the LC display unit 27 is to be again stored at the stand-by position within the housing 21, a down switch not shown is manually turned on to initiate reverse rotation of the tilt drive motor 38 which thereupon operates to return the LC display unit 27 to the upright position via the transmission gear 37 and the sector gear 34. This state is detected by contact of the rear projection 34*a* of the sector gear 34 with the upright sensor 49 on the slide board 24 (see FIG. 5). The upright sensor 49 thereupon passes a detection signal to the tilt drive motor 38 in order to stop rotation of the latter. Because rotation of the tilt drive motor 38 is stopped through contact of the rear projection 34*a* with the upright sensor 49, the LC display unit 27 can always be returned to the upright position starting from any tilted position.

The detection signal from the upright sensor 49 is also passed to the lift drive motor 30 which is thereupon driven for reverse rotation. Then the swing arm 31 rotates counterclockwise in FIG. 2 and the slide board 24 with the LC display unit 27 stares to descend via the rolling contact of the roller 32 with the guide rail 25.

Regarding this descent of the slide board 24 and the LC display unit 27, it should be appreciated that the output power of the lift drive motor 30 is used not for positively pulling down the slide board 24 but for removing resistance against descent of the slide board 24 and the LC display unit 27 by their own weights. As stated above, the guide rail 25 attached to the slide board 24 rides on the roller 32 held by the swing arm 31. Thus, the weights of the slide board 24 and the LC display unit 27 work as a load on the swing arm 31. As the lift drive motor 30 rotates reversely, the swing arm 31 rotates counterclockwise in FIG. 2 while bearing the load but tile swing arm 31 does not positively pull down the slide board 24 via the guide rail 25. This mechanism is very important from the viewpoint of fail-safe function.

More specifically, it is assumed that a foreign matter is accidentally clamped between the LC display unit 27 and the top wall 21*a* of the housing 21 when the former is descending. The LC display unit 27 cannot descend further, the lift drive motor 30 continues its rotation, and the swing arm 31 continues its counterclockwise rotation. The guide rail 25 attached to the slide board 24 stops its descent but the roller 32 at the distal end of the swing arm 31 descends. As a consequence, the roller 32 gets out of its rolling contact with the guide rail 25 and, as a consequence, rotation of the lift drive motor 30 does not forcibly accompany corresponding descent of the slide board 24 with the LC display unit 27.

When there is no accidental presence of a foreign matter, the LC display unit 27 descends smoothly and, on arrival at the lowest descending position, presence of the slide board 24 is detected by the lower sensor 47 which thereupon passes a detection signal to the lift drive motor 30 in order to stop the reverse rotation of the latter. The stopper 46 acts to precisely fix the level of the LC display unit 27 so that the top face thereof should be flush with the top wall 28 of the housing.

With the above-described construction, ascent and descent of the LC display unit 27 necessitates a quarter rotation of the swing arm 31 only which requires a relatively small ambit only. No use of the pinion-rack combination and the large table for bearing a display unit is needed. These concur to reduce the weight and size of the lifter significantly.

Holding of the display unit via the rolling contact between the slide board side guide rail and the drive motor side roller provides reliable fail-safe function of the lifter.

Use of the elastic contact mechanism associated with the tile drive motor allows free manual choice of the degree of inclination of the display unit screen.

Since all the elements including various sensors are collectively mounted to the main frame hanging down from to top wall of the housing, they can be readily removed from the housing for maintenance and replacement purposes.

We claim:

1. A display unit lifter comprising a housing having an upper opening for passage of a display unit;

a display lifting unit arranged within said housing and including (a) a lift drive motor fixedly mounted to said housing and (b) a slide board mechanically coupled to said lift drive motor for vertical movement within said housing and carrying said display unit overhead via at least one hinge;

a display tilting unit mounted to said display lifting unit and including (a) a tilt drive motor mounted to said slide board and (b) means for converting rotation of said tilt drive motor into corresponding tilting of said display unit about said hinge on said slide board; and a lift detector unit arranged facing a path of said vertical movement of said slide board within said housing and electrically connected to said lift drive motor of said display lifting unit as well as to said tilt drive motor of said display tilting unit.

2. A display unit lifter as claimed in claim 1 in which said display lifting unit further includes a horizontal guide rail attached to a top end of said slide board, a radial swing arm fixed to an output shaft of said lift drive motor, and a roller held by said swing arm in rolling contact with a lower face of said guide rail.

3. A display unit lifter as claimed in claim 1 in which said converting means of said display tilting unit includes, a transmission gear coupled to an output shaft of said tilt drive motor, and a sector gear coupled to a lower end of said display unit in meshing engagement with said sector gear.

4. A display unit lifter as claimed in claim 3 in which said transmission gear is coupled to said output shaft via an elastic contact mechanism including a spring.

5. A display unit lifter as claimed in claim 1 in which said lift detector unit includes, a lower sensor arranged near a lowest descending position of said slide board, an upper sensor arranged near a highest ascending position of said slide board, and an upright detector arranged facing said converting means of said display tilting unit.

6. A display unit lifter as claimed in claim 1 in which said slide board is spring urged upwards.

* * * * *